US009156580B2

(12) United States Patent
Ladanyi

(10) Patent No.: US 9,156,580 B2
(45) Date of Patent: Oct. 13, 2015

(54) CLOSURE APPARATUS SUITABLE FOR EATING UTENSILS AND METHODS OF MAKING AND USING SAME

(71) Applicant: Donald J. Ladanyi, West Lake, OH (US)

(72) Inventor: Donald J. Ladanyi, West Lake, OH (US)

( * ) Notice: Subject to any disclaimer, the term of this patent is extended or adjusted under 35 U.S.C. 154(b) by 0 days.

(21) Appl. No.: 13/953,325

(22) Filed: Jul. 29, 2013

(65) Prior Publication Data

US 2014/0027331 A1 Jan. 30, 2014

Related U.S. Application Data

(60) Provisional application No. 61/676,657, filed on Jul. 27, 2012.

(51) Int. Cl.

| | |
|---|---|
| ***A45C 13/00*** | (2006.01) |
| ***B65D 5/00*** | (2006.01) |
| ***B65D 43/16*** | (2006.01) |
| ***B65D 5/52*** | (2006.01) |
| ***A47G 21/14*** | (2006.01) |

(52) U.S. Cl.

CPC ..... *B65D 5/009* (2013.01); *A47G 21/14* (2013.01); *B65D 5/5213* (2013.01); *B65D 43/16* (2013.01)

(58) Field of Classification Search

CPC ..... A45C 13/02; A45C 3/00
USPC ..... 206/553; 229/67.1, 67.3, 928
See application file for complete search history.

(56) References Cited

U.S. PATENT DOCUMENTS

| | | | | |
|---|---|---|---|---|
| 1,220,559 | A * | 3/1917 | Riebe | 206/553 |
| 2,729,258 | A * | 1/1956 | Pentland et al. | 206/553 |
| 2,746,505 | A * | 5/1956 | Howard | 206/757 |

FOREIGN PATENT DOCUMENTS

FR 2586766 A1 * 3/1987

* cited by examiner

*Primary Examiner* — Steven A. Reynolds
*Assistant Examiner* — King M Chu
(74) *Attorney, Agent, or Firm* — The Weintraub Group, P.L.C.

(57) ABSTRACT

A closure apparatus that has a base having an interior surface, a lid having an interior surface, and a plurality of compartments within the apparatus. The lid is rotatably connected to the base, and a first compartment of the plurality of compartments has a wall secured to the interior surface of the lid and a wall of a second component is secured to the face such that, upon rotation of the lid, at least some of the compartments rise open from a relatively compressed state. The compartments removably straw an eating utensil which are easily displayed in and removed from their respective compartments.

11 Claims, 2 Drawing Sheets

FIG 1
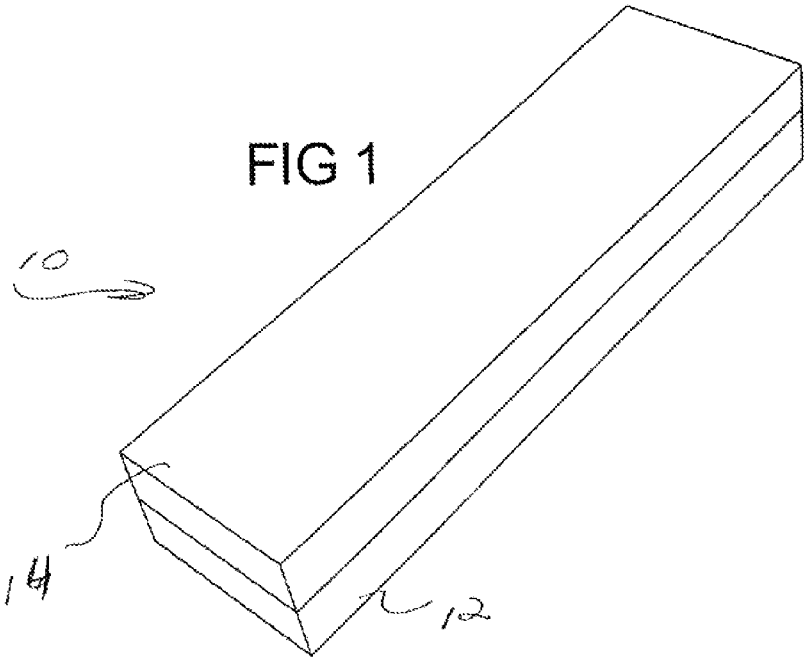
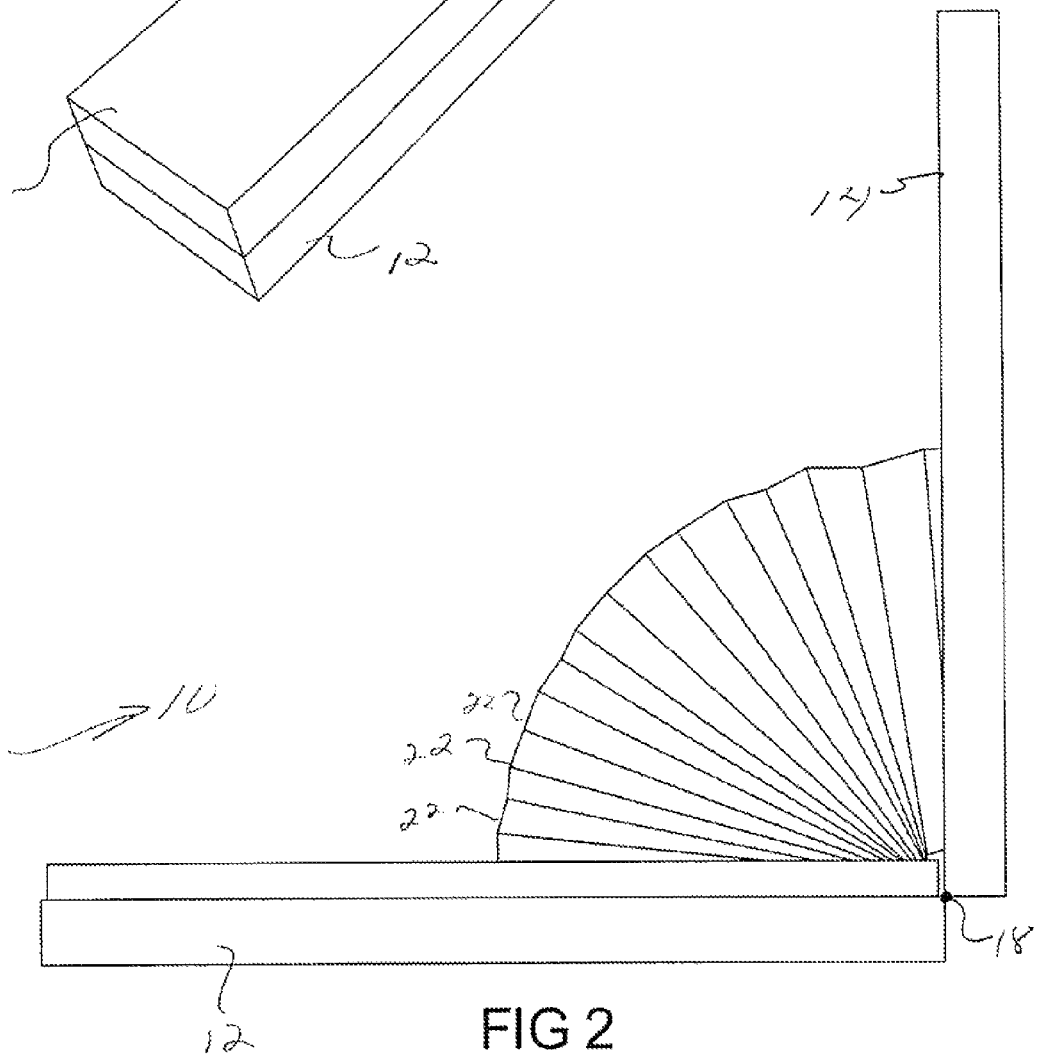
FIG 2

CLOSURE APPARATUS SUITABLE FOR EATING UTENSILS AND METHODS OF MAKING AND USING SAME

CROSS-REFERENCE TO RELATED APPLICATIONS

This application is a completion application of U.S. Provisional Patent Application Ser. No. 61/676,657, filed Jul. 27, 2012, the entire disclosure of which, including the drawing, is hereby incorporated by reference.

BACKGROUND OF THE INVENTION

1. Field of the Invention

This invention relates generally to storage devices, such as gift boxes and secure-hold shipping boxes and more particularly to closure apparatus in which eating utensils may be stored in such a manner as to prevent contamination and/or to dynamically display in an attractive manner, as well as methods for making and using such closure apparatus.

2. Prior Art

Various types of cutlery holding devices are known. For example, U.S. Pat. No. 1,220,559 entitled "Holder for Tableware" issued to Riebe on Mar. 27, 1917, a soft fabric holder for tableware of a type from which tableware utensils are inserted or withdrawn is described. The holder described in the '559 patent can be constructed of a suitable soft material and has a number of compartments adapted to receive an article of tableware. However, the disclosed tableware holder has side walls into which the utensils must be placed and from which they must be removed, which may not be regarded as convenient to manufacture today or into which to insert an item of tableware. Furthermore, the space on top of the disclosed tableware holder for insertion and removal of utensils is limited and less convenient than may be desired in a modern holder.

U.S. Pat. No. 2,729,258 entitled "Silver Flat-Ware Case" issued Jan. 3, 1956 to Pentland et al. describes a silver flatware case for use in the home wherein multiple place-settings may be conveniently stored and retained when not in use. The apparatus described in the '258 patent is a flexible multi-compartmented or multi-partitioned expansible and collapsible case having partitions of gradually varying height. The case will stand up on its base with the partitions in a vertical position. However, the disclosed case does not scale well to single person place settings, and it may be considered inconvenient at a meal to stand the case upright on its base to remove the utensils from the case at a meal.

U.S. Pat. No. 3,915,213 entitled "Silverware Holder" issued Oct. 28, 1975 to Graham, Jr., discloses what appears to be a silverware holder having rigid compartments. The size, rigidity and weight of such an apparatus may also make such a holder inconvenient for use to enclose a place setting at a table.

U.S. Pat. No. 7,290,661 entitled "Cutlery Tray with Roll-Top Enclosure" issued Nov. 6, 2007 to DeFino discloses a cutlery receptacle that includes a housing having a roll-top cover movable between an open and a closed position with mating members of a locking mechanism incorporated respectively in the housing and cover. Although this type of enclosure might, in principle, provide a convenient holder for a place setting at a table, its construction is rather complex and the apparatus itself may be so expensive as not to be considered disposable.

It would thus be desirable to provide a closure or a box that can be used as a holder for a place setting at a table, and yet is attractive and simple to make while being inexpensive enough to be considered disposable.

SUMMARY OF THE INVENTION

In one aspect, the present invention provides a closure apparatus including a base having an interior surface, and a lid having an interior surface. A plurality of compartments are provided within the apparatus. The lid is rotatably connected to the base. A first compartment of the plurality of interconnected compartments has a wall secured to the interior surface of the lid. Similarly, a wall of a second or last compartment is secured to the base of the closure to complete securement of the compartments to the apparatus such that, upon rotation of the lid, at least some of the compartments open from a relatively compressed state.

The bottoms of each of the sidewalls defining each compartment are bonded together, as at 27, to define a V-shaped floor.

Because of the configuration of the device, as it is opened, any utensils within the compartment will be shifted toward their respective back walls due to gravity. Further, opening of the compartment will cause the utensils within the compartment to shift to the center of the compartment where it is stabilized in place due to the V-shape of the floor.

In another aspect of the present invention a method for displaying eating utensils to a person includes placing an eating utensil in a compartment in the closure apparatus described above. By virtue of the construction each compartment levels, aligns and centers the utensil for maximum display uniformity.

For a more complete understanding of the present invention, reference is made to the following detailed description and accompanying drawing. In the drawing like reference characters refer to like parts throughout the several views in which:

BRIEF DESCRIPTION OF THE DRAWING

FIG. 1 is a perspective view of the closure in the closed position;

FIG. 2 is a side view of the closure apparatus in the open position; and

DETAILED DESCRIPTION OF THE PREFERRED EMBODIMENT

Figure 3:
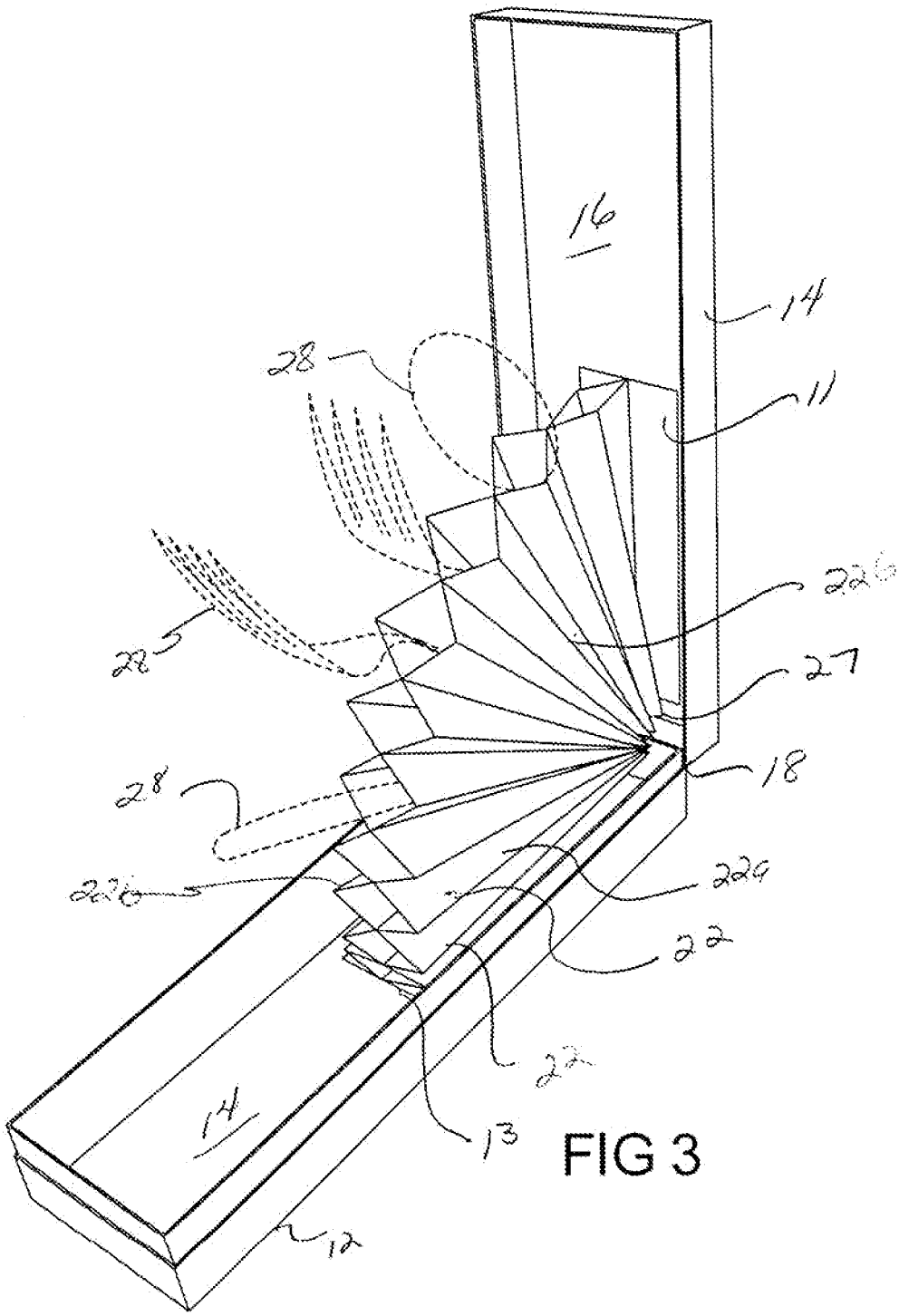
FIG. 3 is a perspective view of the closure apparatus in the open position.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

In accordance herewith and with reference to the drawing, a closure apparatus 10 includes a base 12 having an interior surface 17 and a lid 14 having an interior surface 16. The lid and base each have internally disposed planar cellulosic elements 11, 13, respectively, secured thereto. These elements each define securement surfaces for adhering a pleat of the first and last compartments thereto, as described below.

The lid 14 is rotatably connected to the base 12, such as by a hinge 18. The hinge 18 may comprise a piece of flexible adhesive paper or tape adhered to the outside of both base 12 and to lid 14 where they meet; a conventional rod and bracket interconnecting the base and lid, or the like.

The apparatus 10 further includes a plurality of compartments 22, each comprising opposed first and second sidewalls 22*a* and 22*b*. Each sidewall is pleated as at 22*c* to define accordion-style compartments within closure apparatus 10. One of pleated compartments 22 includes a wall 24 that is secured to the interior surface 16 of lid 14 such that, upon rotation of lid 14, at least some pleated compartments 22 open from a relatively compressed state. The opposed compartment 22' is similarly secured to the interior 19 of the base 12, such that upon rotation of lid 14, at least some pleated compartments 22 open from a relatively compressed state.

More particularly, in the illustrated embodiment, pleated compartments 22 are compressed in a first direction when the lid 14 is closed, fan open as lid 14 is opened, and eventually can become compressed in a second, perpendicular direction as lid 14 is more fully opened. It is not required that the compression of pleated compartments 22 be complete or extremely tight in either direction. However, as pleated compartments 22 open and become compressed in the second perpendicular direction, the content of the compartment, such as eating utensils 28, stored in the pleated compartments 22 may rotate.

The bottoms or bottom edge of each of the sidewalls defining each compartment are bonded together, as at 27, to define a V-shaped floor.

Because of the configuration of the device, as it is opened, any utensils within the compartment will be shifted toward their respective back walls due to gravity. Further, depending on their size opening of the compartment may cause the utensils within the compartment to shift to the center of the compartment where it is stabilized in place due to the V-shape of the floor.

The closure apparatus 10 preferably comprises a cellulose material such as cardboard and paper.

In another aspect, some embodiments of the present invention include a method for providing eating utensils 28 to a person. The method includes placing at least one eating utensil 28 in at least one pleated compartment 22 in a closure apparatus 10 having a base 12 and an inclined interior surface 19 and a lid 14 that, itself, has an interior surface 16. Lid 14 is rotatably connected to base 12, and closure apparatus 10 further comprises a plurality of operatively connected pleats 20 enclosing pleated compartments 22 within closure apparatus 10. A first pleated compartments 22 has a pleat secured to the interior element 11 of lid 14 such that, upon rotation of lid 14, at least some pleated compartments 22 open from a relatively compressed state so that an eating utensil appears to rise in its pleated compartment when lid 14 is rotated. Similarly, the last of the compartments has a pleat secured to element 13, as shown.

In yet another aspect hereof, a method for making a closure apparatus 10 includes affixing a pleat of a plurality of pleated compartments to lid 11 of the closure apparatus 10. The method further includes affixing a second pleat of the back of plurality pleated compartments to an element 13 of the base 12 of the closure apparatus 10. The base and lid are hingedly interconnected by any suitable means such that upon rotation of lid 14, at least some pleated compartments 22 open from a relatively compressed state.

In manufacturing the present closure the forces are equally distributed through the lid, base and walls of each compartment such that the device has a "unibody" construction. This eliminates bloating, sagging or disfiguration of a single loaded or unloaded compartment provided that heavy-weight, spring-like stiff paper is used, since this causes the forces to be equally divided among all compartments equally along the center line. Since the compartments have angled floors they level, align and center the tableware laterally for maximized display. Gravity is used dynamically for front to back alignment on all compartments during opening so no product can be out of place longitudinally.

The present device or apparatus enables easy access of each product via total visual identification and easy one-hand removal.

The positive clamping enclosure enables the apparatus to protect product and to enable the apparatus to function as a shipping container and display, also.

It will thus be appreciated that various embodiments of the present invention provide a closure or a box that can be used as a holder or as a display being both attractive and simple to make while being inexpensive enough to be considered disposable.

What is claimed is:

1. A closure apparatus comprising:

a base having an interior surface and an outer surface;

a lid having an interior surface and an outer surface;

a hinge interconnecting the base and the lid for enabling rotation of the base and the lid with respect to each other; and a plurality of compartments within the apparatus, wherein a first of the plurality of compartments comprises a first wall secured to the interior surface of the lid and a second of the plurality of compartments comprises a second wall secured to the interior surface of the lid such that, upon rotation of the lid, at least some of the plurality of said compartments open from a relatively compressed state to an at least partially open state.

2. The closure apparatus of claim 1 further comprising an eating utensil housed in one of the plurality of compartments.

3. The closure apparatus of claim 2 wherein the one of the plurality of compartments housing the utensil is configured to rotate the eating utensil when the lid is opened.

4. The closure apparatus of claim 2 wherein the eating utensil comprises a flat handle and a food manipulating part, and further wherein said compartments are dimensioned to expose the food manipulating part of the eating utensil when the eating utensil is inserted into one of the compartments.

5. The closure apparatus of claim 2 wherein the eating utensil comprises a plastic eating utensil.

6. The closure apparatus of claim 1 wherein the closure apparatus comprises a cellulosic material.

7. A method for providing eating utensils to a person, said method comprising:

providing an openable and closable apparatus, the apparatus comprising:

a base having an interior surface and an outer surface;

a lid having an interior surface and an outer surface;

a hinge interconnecting the base and the lid for enabling rotation of the base and lid with respect to each other, at least one utensil removably stowed in one of the plurality of compartments and wherein upon opening the apparatus and rotating the lid, the at least one utensil is exposed for grasping; and a plurality of compartments within the apparatus, wherein a first of said compartments comprises a first wall secured to the interior surface of the lid and a second of the plurality of compartments comprises a second wall secured to the interior surface of the lid such that, upon rotation of the lid, at least some of the plurality of said compartments open from a relatively compressed state to an at least partially open state.

8. The closure apparatus of claim 1 wherein each of the plurality of component comprises opposed first and second walls, each sidewall being pleated to define an accordion-style compartment.

9. The closure apparatus of claim 8 wherein the bottom edge of each sidewall of each compartment is bonded together to define a V-shaped floor.

10. A kit, comprising;

(a) the closure apparatus of claim 1 and;

(b) a plurality of eating utensils, each utensil being removably emplaceable in an associated one of the plurality of compartments.

11. The kit of claim 10 wherein each of the compartments is configured to rotate the utensil when the lid is opened.

* * * * *